US007090086B2

(12) United States Patent
Dupre et al.

(10) Patent No.: US 7,090,086 B2
(45) Date of Patent: Aug. 15, 2006

(54) EXTENDIBLE BOOM WITH REMOVABLE HYDRAULIC HOSE CARRIER

(75) Inventors: Henri R. M. Dupre, Ponchateau (FR); Arnaud J. M. Guinee, Rieux (FR); Cyrille P. J. Boussaud, Saint Brevin les Pins (FR); Bernard J. H. Poncet, Nantes (FR)

(73) Assignee: Clark Equipment Company, Woodcliff Lake, NJ (US)

( * ) Notice: Subject to any disclaimer, the term of this patent is extended or adjusted under 35 U.S.C. 154(b) by 390 days.

(21) Appl. No.: 10/428,472

(22) Filed: May 2, 2003

(65) Prior Publication Data

US 2003/0205547 A1 Nov. 6, 2003

Related U.S. Application Data

(60) Provisional application No. 60/377,420, filed on May 3, 2002.

(51) Int. Cl.
*B66C 23/04* (2006.01)

(52) U.S. Cl. ..... 212/350; 52/118

(58) Field of Classification Search ..... 212/350; 52/118

See application file for complete search history.

(56) References Cited

U.S. PATENT DOCUMENTS

| | | | | | |
|---|---|---|---|---|---|
| 3,214,033 | A | | 10/1965 | Nilsson | 212/55 |
| 3,284,036 | A | * | 11/1966 | Nansel | 248/49 |
| 3,305,220 | A | * | 2/1967 | Nevulis | 254/387 |
| 3,893,480 | A | * | 7/1975 | Dunbar | 137/615 |
| 3,967,744 | A | | 7/1976 | Goyarts | 214/770 |
| RE30,021 | E | | 6/1979 | Olson et al. | 414/547 |
| 4,226,300 | A | * | 10/1980 | Rallis et al. | 182/2.11 |
| 4,360,077 | A | * | 11/1982 | Abbott | 182/2.11 |
| 4,382,743 | A | | 5/1983 | Newell | 414/692 |
| 4,470,229 | A | | 9/1984 | Muse et al. | 52/118 |
| 4,687,073 | A | * | 8/1987 | Ashworth | 182/2.11 |
| 4,789,120 | A | * | 12/1988 | Spidel | 248/49 |
| 4,809,472 | A | * | 3/1989 | Hade et al. | 52/118 |
| 5,199,861 | A | | 4/1993 | Merlo et al. | 414/718 |
| 5,718,345 | A | | 2/1998 | Hade, Jr. | 212/349 |
| 5,924,837 | A | * | 7/1999 | Passmann | 414/718 |

FOREIGN PATENT DOCUMENTS

| | | | |
|---|---|---|---|
| FR | 2 699 909 | | 12/1992 |
| GB | 2 365 505 | A | 2/2002 |
| JP | 7-31561 | * | 12/1995 |
| WO | WO 88/09304 | | 4/1988 |
| WO | 88/09304 | * | 12/1988 |

* cited by examiner

*Primary Examiner*—Thomas J. Brahan
(74) *Attorney, Agent, or Firm*—Nickolas E. Westman; Westman, Champlin & Kelly, P.A.

(57) ABSTRACT

A telescoping boom has a plurality of boom sections, and the boom sections nest together. The sections include an outer base section, intermediate sections, and an inner section that forms the outer end of the boom when extended. A hydraulic actuator and mechanical flexible links control the extension and retraction of the boom sections, and a hose carrier housing that is mounted as a subassembly carries hoses of sufficient length to carry hydraulic fluid under pressure from a base end of the boom to the outer end. The hose carrier housing supports the hoses folded into lengths in a zigzag form to provide sufficient length for boom extension. All connections to the hoses are accessible at the base end or at the outer end of the inner boom section. The entire hose carrier housing and the hoses are capable of being removed from and replaced into the boom as a unit.

8 Claims, 18 Drawing Sheets

EXTENDIBLE BOOM WITH REMOVABLE HYDRAULIC HOSE CARRIER

This application is based on, refers to and claims priority on Provisional Patent Application Ser. No. 60/377,420, filed May 3, 2002, the content of which is hereby incorporated by reference.

BACKGROUND OF THE INVENTION

The present invention relates to an extendable working boom mounted on a prime mover platform (a support vehicle) that has telescoping boom sections that can elongate to a substantial height, and which have hydraulically operated attachments at an outer end to which hydraulic fluid under pressure must be delivered. The boom has a single operating hydraulic cylinder operable to extend and retract the boom. The boom includes a hydraulic hose and line carrier formed as a cartridge or subassembly that slips into the boom and can be removed as a subassembly unit for service, such as replacement of connections, checking for leaks and the like.

Extendable booms have been made in the past, using a single hydraulic cylinder to extend and retract the boom. However, the assembly of the hydraulic hoses and lines necessary to carry hydraulic fluid under pressure to the outer end of the extendable boom have generally involved complex arrangements with line connections in the interior of the boom tubes, and the consequent need for disassembly of the boom in order to service the hydraulics. Usually the connections that may cause problems are on the interior of one of the boom sections, so difficult procedures have to be followed to remove the hoses and lines that are used.

SUMMARY OF THE INVENTION

The present invention relates to a telescoping hydraulically operated multi-section tubular telescoping boom that has a hydraulic cylinder for extending and retracting the boom sections. A removable and replaceable hydraulic line and hose carrier is inserted into an inner most section of the boom as a cartridge. The carrier or cartridge has the main connections usually threaded connectors at the base of the boom. The hydraulic pumps and valves on the primer mover or mobile platform are at the base of the boom where they are readily accessible for connection to the lines and for subsequent operation. The remote connection ends of the tubes or lines for carrying fluid under pressure to remote implements at the outer end of the outer end section of the boom are also accessible so they can be connected to pressure hoses for carrying power to remote actuators.

The hydraulic line carrier or cartridge subassembly includes an outer housing, and a sufficient length of flexible hoses carried on flexible, chain type hose supports. The lines have connection ends at the base of the carrier subassembly and positioned to the exterior of the carrier housing. The lengths of hydraulic lines at the outer end of the boom are metal tubes that are on the exterior of the carrier housing and supported on the remote end section of the boom. The lines are connected to the remote implements, such as a grapple or lift fork.

The hydraulic line carrier housing slips into the smallest size outer end boom section, which is at the outer or remote end when the boom is extended. The metal hydraulic lines move with the outer end section and the known flexible chain type hose carrier or support, holding the flexible hydraulic hoses is folded or doubled upon itself when the boom is retracted and will unfold as the boom extends. The hoses are guided by the flexible chain hose carrier will double back upon themselves as needed as the boom retracts.

A slide or drawer is mounted in the hose carrier housing and is connected to an intermediate section of the boom and supports the center portions of the folded flexible hydraulic hoses. The base ends of the hydraulic hoses are connected to the end of the base boom section, so the ends of the hoses are easily coupled to the hydraulic system. With the telescoping boom retracted, the base connections of the hydraulic hoses are exposed at the base of the tubular boom and can be connected to lines leading to hydraulic valves on the support platform. The base ends of the hoses carried by the telescoping boom remain at the base of the boom as the boom extends, and as the hose carrier support move outward with the outer end boom section on which it is supported the slide secured to an intermediate boom section will remain on the intermediate and the carrier housing slides out along the slide as the carrier housing moves outwardly as the end sections of the boom are extended and moved outwardly.

In other words, portions of the hoses extend from the carrier housing by unfolding at both the outer end and the base end of the carrier housing as the boom is extended. As the boom retracts the hoses carried on the flexible hose support will fold back into a retracted position as carried by the hose support chain and will be moved within the carrier housing.

The hose carrier housing or cartridge and all of the supported lines and hoses can be removed as a unit by disconnecting the rigid lines from the outer end section of the boom and disconnecting the carrier slide from the intermediate section, as well as loosening the attachment of the ends of the hoses to the base section of the boom. The hose carrier, including the lines and hoses carried thereby, then is slid out of the boom from the base end for service.

The boom extension hydraulic cylinder that operates the extension and retraction of the boom also is connected to the base end of the boom, and can be accessed when the boom is retracted. The connections for this cylinder remain fixed with the outer or base section of the boom. The boom extension hydraulic cylinder and the hose carrier housing are supported side by side in the interior of the boom tubes.

The flexible chain type hose support is a plastic link chain that is used conventionally, and has sections that are of sufficient size to retain a hydraulic hose, and the chain sections then flex at pivot points between the individual sections or links like a roller chain. Suitable top and bottom cross bars or retainers will hold the hoses between the side plates of the chain links so that they do not rub on adjacent surfaces, and are guided positively by the pivoting or rolling action of the chain as it moves.

Service of the hydraulic hoses and lines thus can be accomplished by pivoting the boom to its horizontal position relative to its mobile platform or carriage and extending the boom sufficiently so that the connections of the outer end rigid lines to the outer end section of the boom (which is the innermost section when the boom is retracted) can be removed, and the boom is then retracted so that the bracket for hose carrier housing slide which is connected to an intermediate section is accessible from the base of the boom, as are the brackets for inlet ends of the hoses. These brackets are released and the entire subassembly of all of the extendable and retractable lines are included. The housing itself is not attached to the boom.

DETAILED DESCRIPTION OF THE PREFERRED EMBODIMENTS

Figure 1:
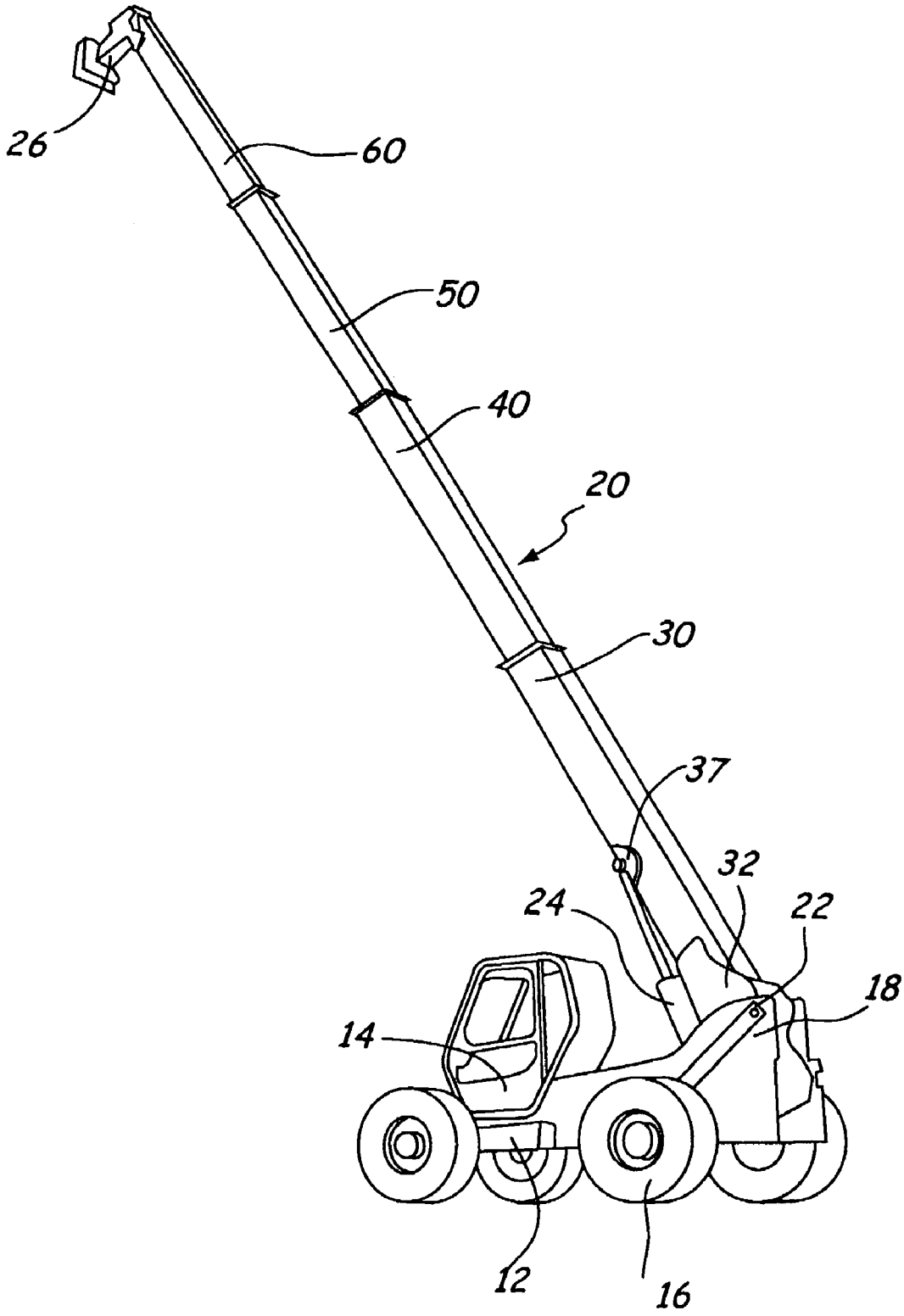
FIG. 1 is a side elevational view showing a boom made according to the present invention, supported on a mobile platform, and in an extended position.

In FIG. 1, mobile boom machine 10, as shown, includes a mobile vehicle platform or base frame 12 that has an operator's cab 14 and which is mounted on drive and steering wheels 16, and is powered by a suitable engine (not shown) that runs the hydraulic system for providing hydraulic fluid under pressure.

The platform 12 has a boom mount bracket 18 that mounts a telescoping boom assembly 20. The telescoping boom assembly is raised and lowered about a pivot pin 22 mounted on the bracket 18, using a pair of hydraulic actuators 24 having their bases mounted on frame or platform 12 and rod ends connected to plates 37 on a base boom section 30 to cause the boom to be raised and lowered under hydraulic power about the pivot 22.

A tool carrier 26 at the outer end of the boom assembly 20, is hydraulically powered, and various power tools are required at this outer end. The boom assembly 20 thus has to carry hydraulic power from a pump and other hydraulic source on the vehicle to the equipment at attachment 26. A subassembly for carrying hydraulic hoses and fixed hydraulic lines that will permit the boom to be extended as shown in FIG. 1, as well as retracted, is provided.

In FIG. 1, the boom assembly 20, as shown, has a base boom section 30, which is a first section; a second section 40 which telescopes and slides inside the base boom section 30; a third section 50 which telescopes inside the second section 40; and therefore also inside the first boom section; and an outer end or fourth section 60 which telescopes on the interior of all the other tubular boom sections and carries the power connections and support 26. The base boom section 30 has a bracket 32 that mounts to pivot bracket 18 and plates.

Figure 2:
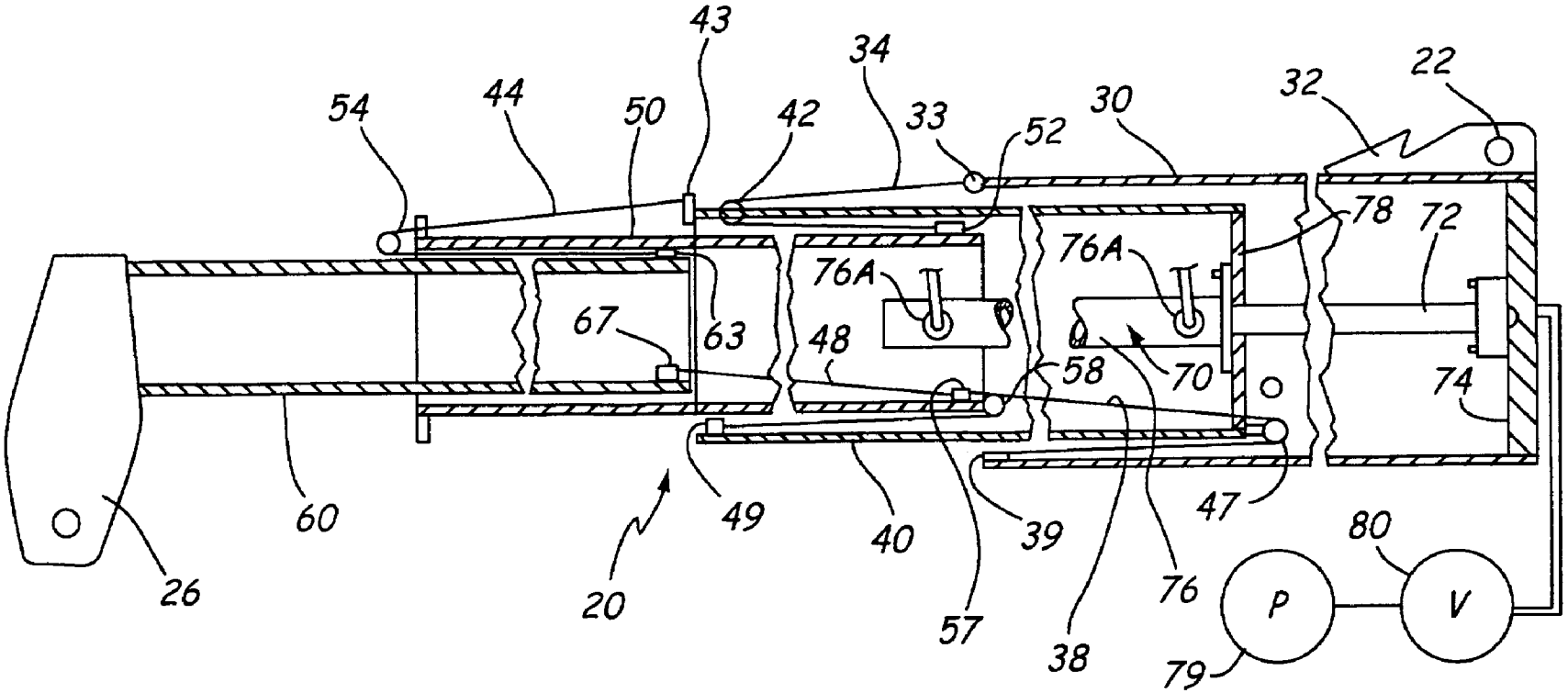
FIG. 2 is a sectional view schematically showing the boom sections (not to scale) and the operating actuator for the telescoping action of the boom sections.

FIG. 2 is a schematic illustration of the boom assembly 20 separated from the platform 12 and support 18. Pivot pin 22 on bracket 32 is illustrated at the base first boom section 30. As shown schematically in FIG. 2, the extension and retraction of the tubular telescoping boom sections is carried out with a double acting hydraulic cylinder assembly 70 having an extendable and retractable rod 72. The outer end of rod 72 is connected to a suitable support 74 at the base of the first boom section 30, and the rod end of the cylinder 76 is connected to a suitable support plate 78 that is attached to the base end of the second boom section 40. The rod 72 extends through the support plate 78.

Hydraulic fluid under pressure from a pump 79, shown schematically, provided through a control valve 80 of conventional design, is provided to the interior of the cylinder 76. The fluid under pressure acts on a selected side of a piston that operates to extend or retract the rod 72. Hydraulic fluid under pressure can be provided to the interior of the cylinder 76 through passageways in the rod 72, and suitable connections or with hoses connected to ports 76A in a normal manner. The specific way of supporting the cylinder 76 and the rod 72 on the respective base and second boom sections is shown only schematically and can be conventionally done.

Figure 3:
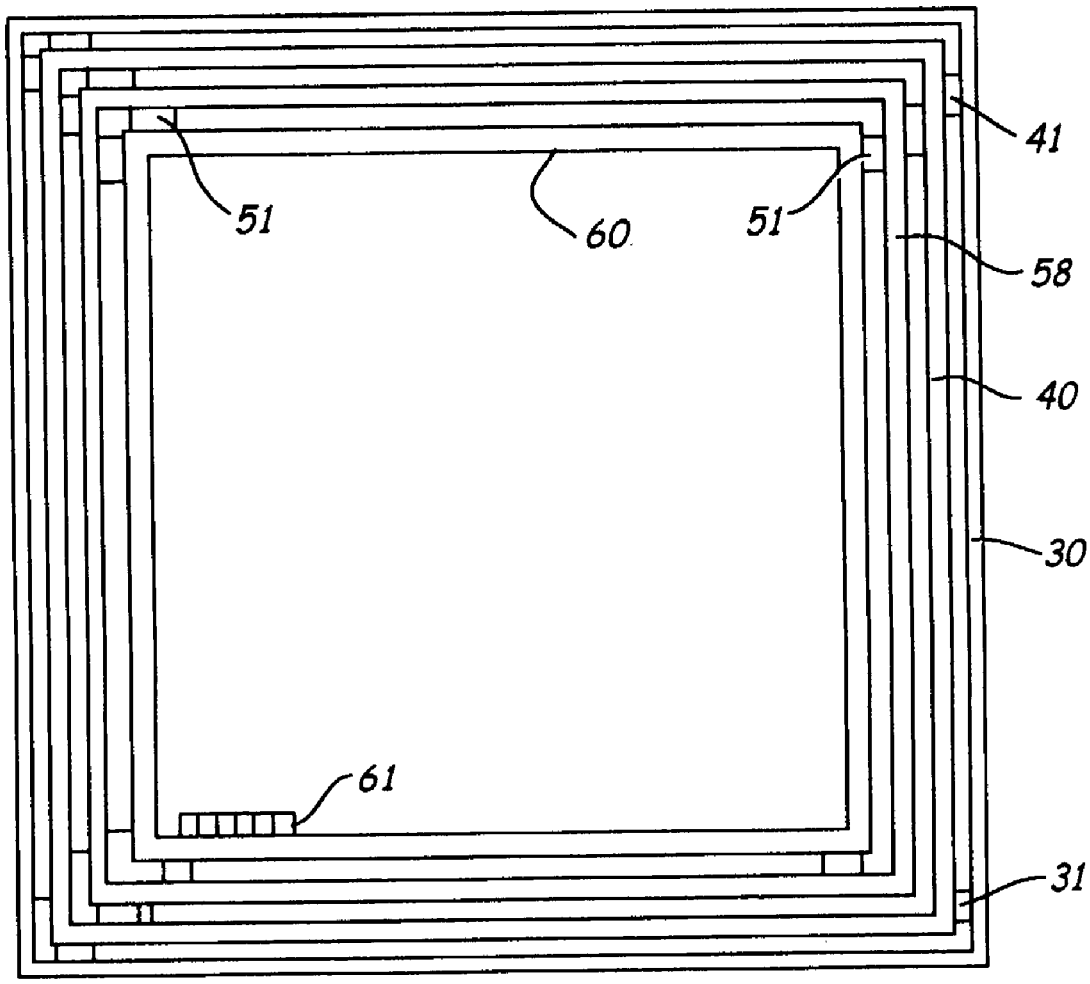
FIG. 3 is an end view of the tubular telescoping boom sections schematically showing the nesting arrangement of the boom sections.

In order to have the telescoping boom sections all telescope, they are sized so they can be nested, as shown in FIG. 3. Also as shown in FIG. 3, suitable wear pads are provided between the sliding boom sections, including wear pads or linear bearings 31 between the first base boom section 30 and the second boom section 40; wear pads 41 between the boom section 40 and the third boom section 50, and wear pads 51 between the third boom section 50 and the fourth or outer end boom section 60.

These wear pads are suitably located for providing bearing supports along the telescoping lengths of the boom sections from the retracted position to the extended position.

Figure 9:
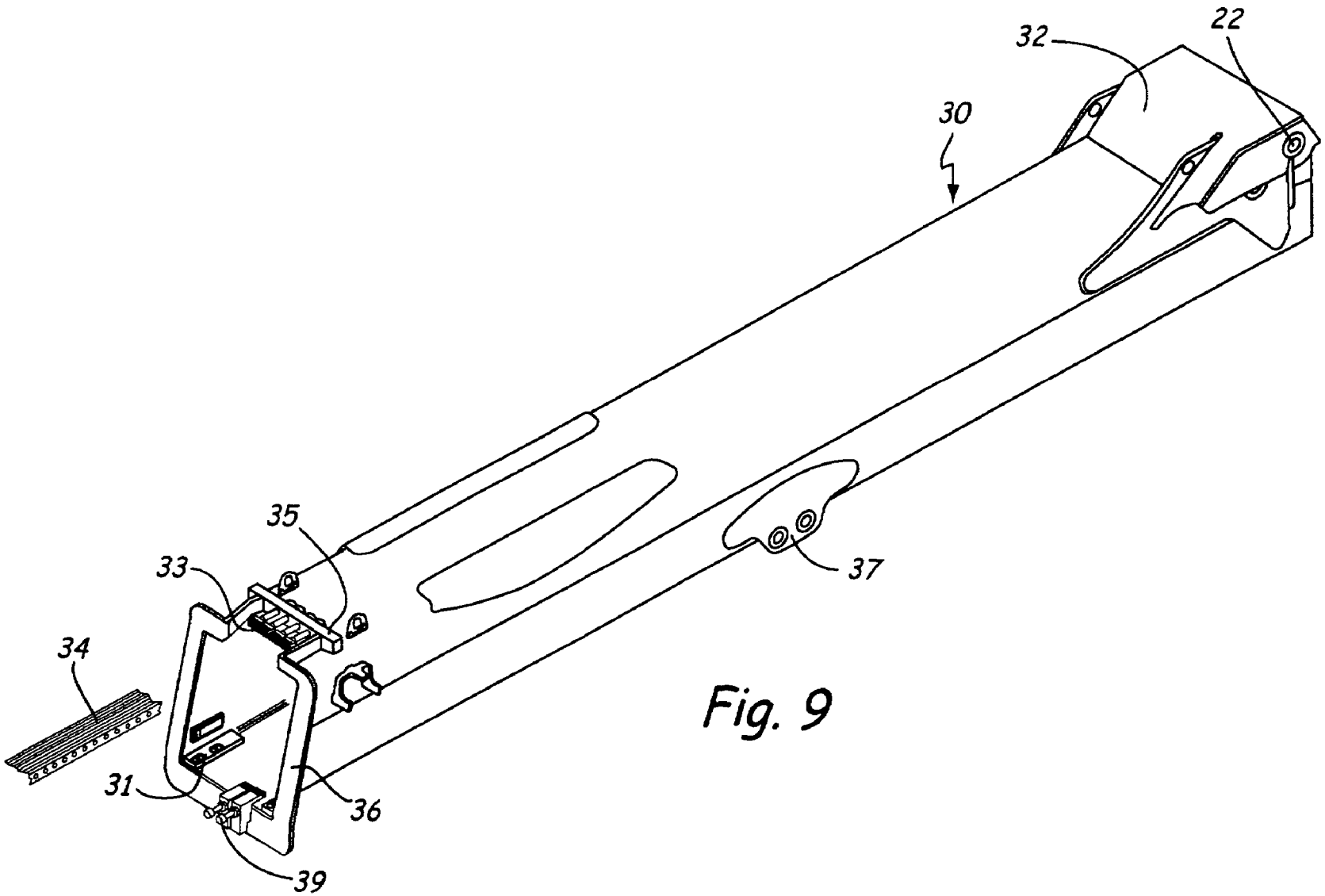
FIG. 9 is an exploded perspective view of the base tube boom section.

Schematically shown in FIG. 2, is a cable and pulley arrangement for controlling the relative movement of the boom sections. Also, reference will be made to the detailed perspective views of the respective boom sections. The base or first boom section 30 is shown in FIG. 9, and the pivot pin opening 22 is illustrated at the base end. The bracket 32 is illustrated. Bracket 32, and thus the boom assembly, is pivotally attached to the bracket 18 on the mobile platform or frame 12.

In FIG. 2, the base boom section 30 has an attachment bracket 33 that is used for connecting a flexible chain 34 to the outer end of the base boom section. The flexible chain 34 mounts over a pulley 42 that is rotatably mounted near the outer end of the second boom section 40, which telescopes inside the base or first boom section 30. Chain 34 then dead ends at an anchor fitting 52 mounted on the base end of the third boom section 50.

In FIG. 9, the connecting brackets 33 for the multiple chains 34 that form a chain set are illustrated, and it can be seen that they fit onto a support member 35, that is provided at the outer end of the first or base boom section 30. A flange 36 is placed around the outer end of the first boom section. The linear bearings 31 are also illustrated at that end of the base boom section 30.

The extension or retraction of boom section 40 relative to base boom section 30 is directly controlled by the action of the hydraulic cylinder assembly 70, when the rod is extended or retracted. In FIG. 2, the boom sections are shown partially extended, and as the second boom section 40 extends, the chain set 34, (or cables), will be acted on by the pulley 42 as it moves, and will create a load on the anchor fitting 52 causing the boom section 50 to extend from the boom section 40.

The second boom section 40 has a chain anchor 43 at an outer end thereof, that anchors control chain set 44, which in turn mounts over a pulley or idler 54 or third boom section 50. The chain 44 set has a section or length that goes back inside the third boom section 50 and is anchored to the outer boom section 60 at an anchor fitting 63. Anchor fitting 63 is near the inner end of the outer end or fourth boom section 60, that will be explained in the detailed views as well.

It should also be noted in FIG. 9, that the mounting plates 37 are provided along the sides of the boom section 30 for attaching the outer ends of the rods of the cylinders 24 that control the boom assembly pivoting. There are two such cylinders mounted in parallel.

Figure 10:
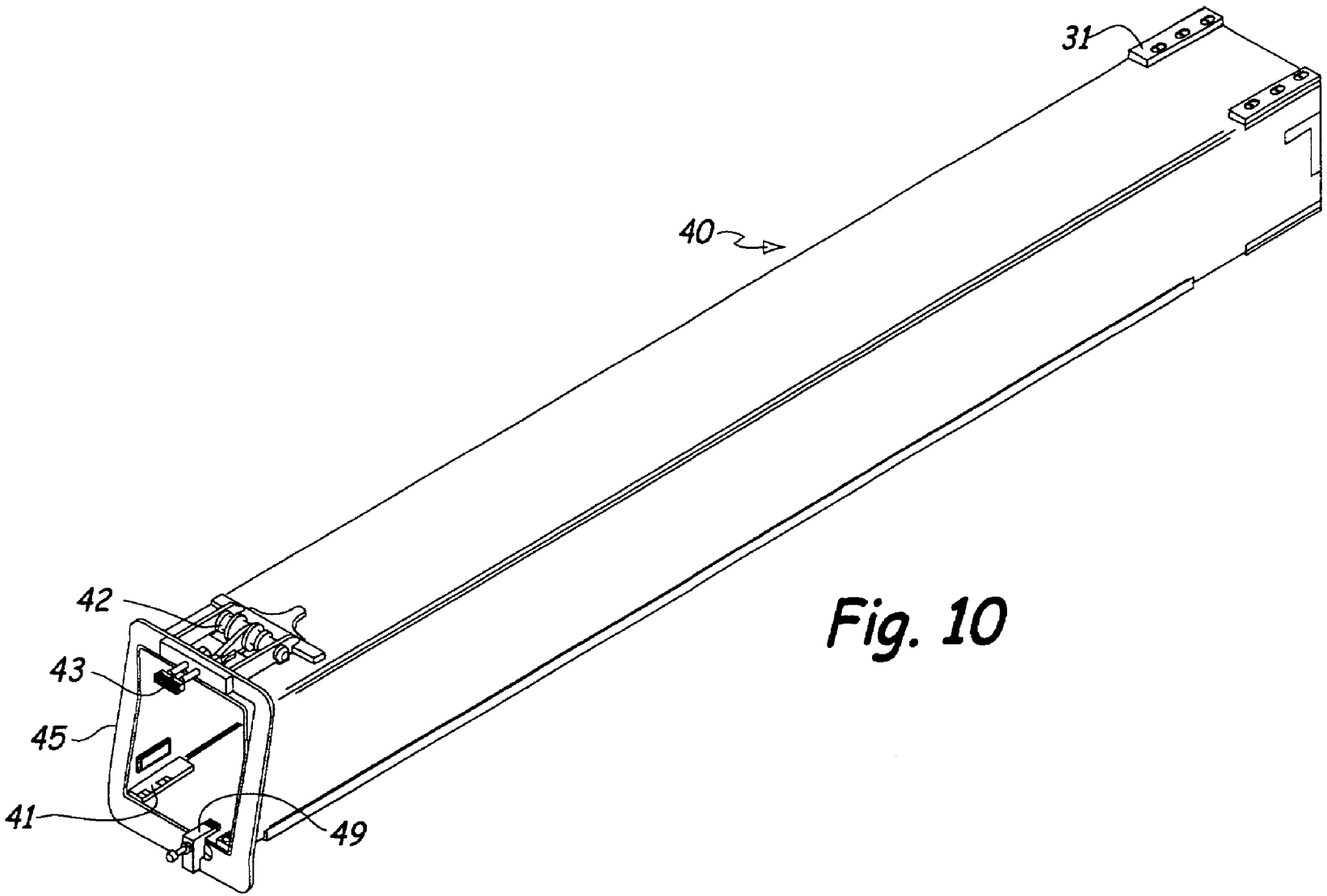
FIG. 10 is a perspective view of a second boom section that slides into the base boom section of FIG. 9.
Figure 11:
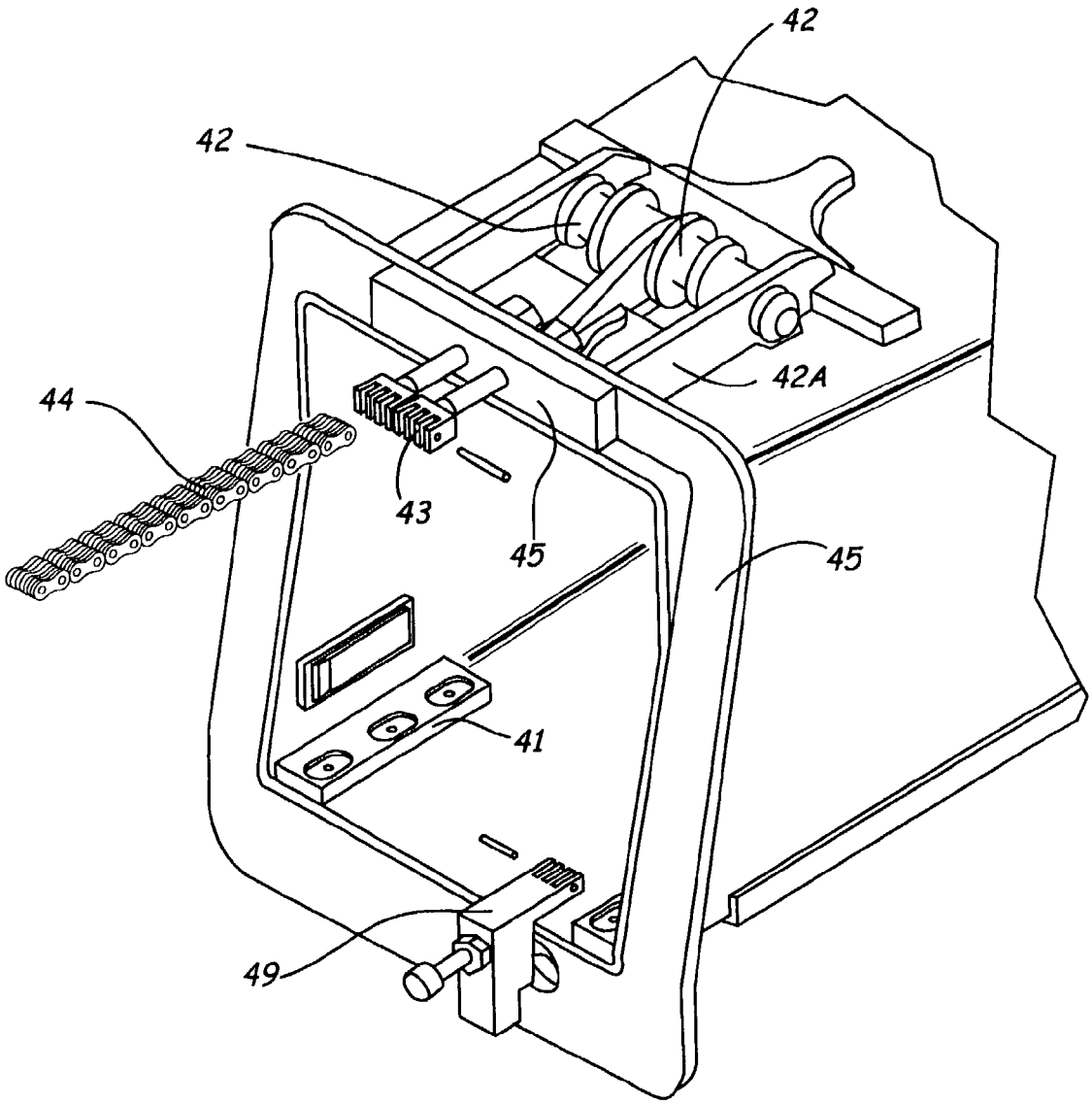
FIG. 11 is a detailed enlarged fragmentary perspective view of an outer end of the second boom section shown in FIG. 10.
Figure 12:
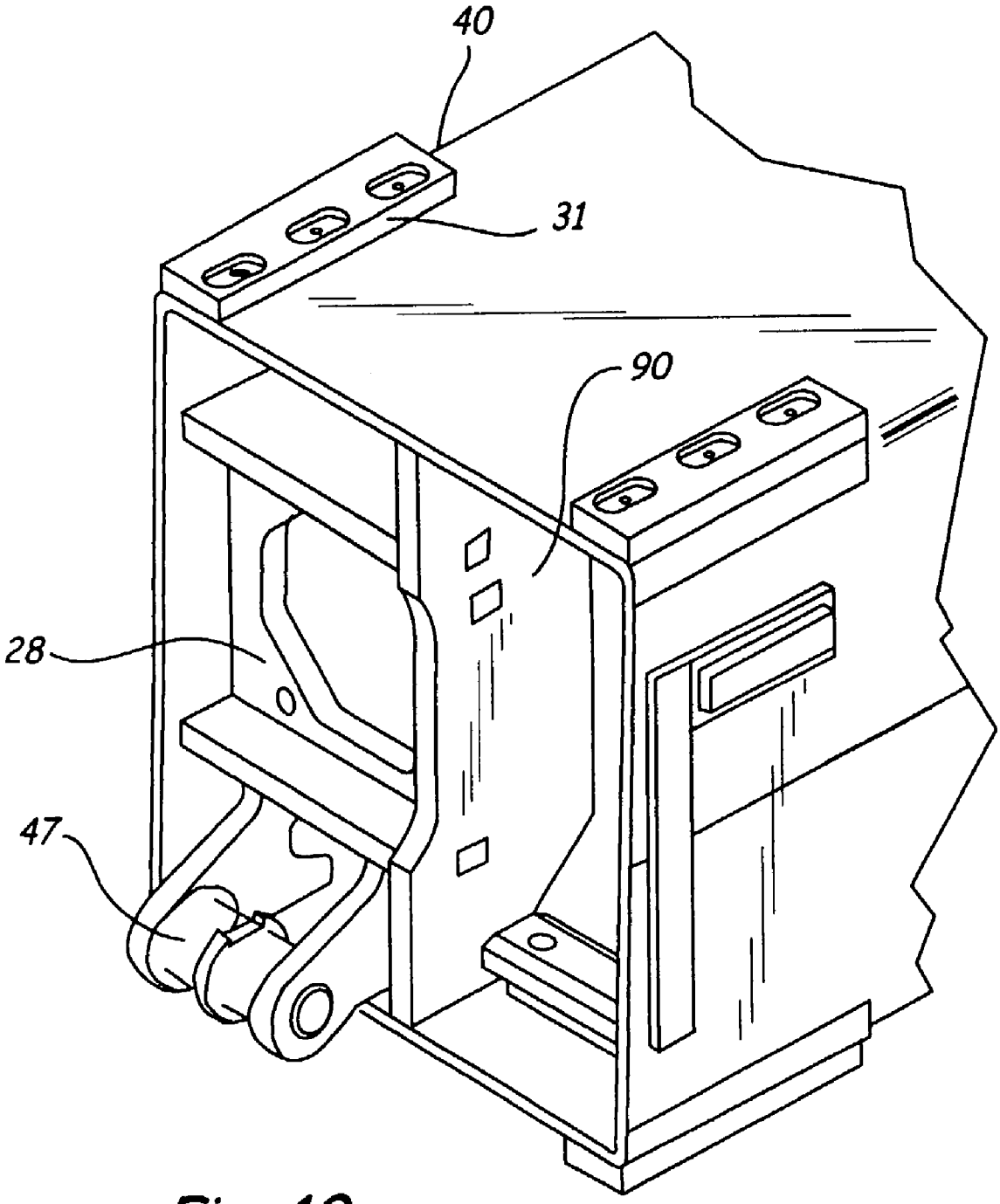
FIG. 12 is an enlarged detailed perspective view of the base end of the second boom section shown in FIG. 10.

In FIGS. 10, 11 and 12, the second boom section 40 is illustrated in more detail, and it can be seen that the bearings or pads pads 41 are at the outer end of the boom section 40, as shown in FIG. 10. In FIG. 11, the pulleys 42 that are at the outer end of the boom section 40 are shown. They are mounted on a frame work 42A. The pulley 42 guides the chain set 34. A short section of chain set 34 is shown in FIG. 9, in the exploded view. The boom section 40 can have wear pads 31 at its base end, as seen, and pads 41 at its outer end.

It can be seen that the chain set has more than one side-by-side chain section, as needed to provide adequate strength.

The boom section 40 has chain anchor 43 mounted on a flange 45, that surrounds the outer end of the boom for reinforcement and also for guiding and stopping. Chain 44 is illustrated in FIG. 11. The chain anchors 43 are backed with a member 46 on flange 45. Flange 45 is a reinforcement, as well as having mounting surfaces that can act as a stop member. The pulleys 42 are rotatably mounted in recesses in the outer end of the boom section 40, so that the chain set 34 will pass around the pulleys and into the interior of the boom section 40, as shown schematically in FIG. 2.

Figure 13:
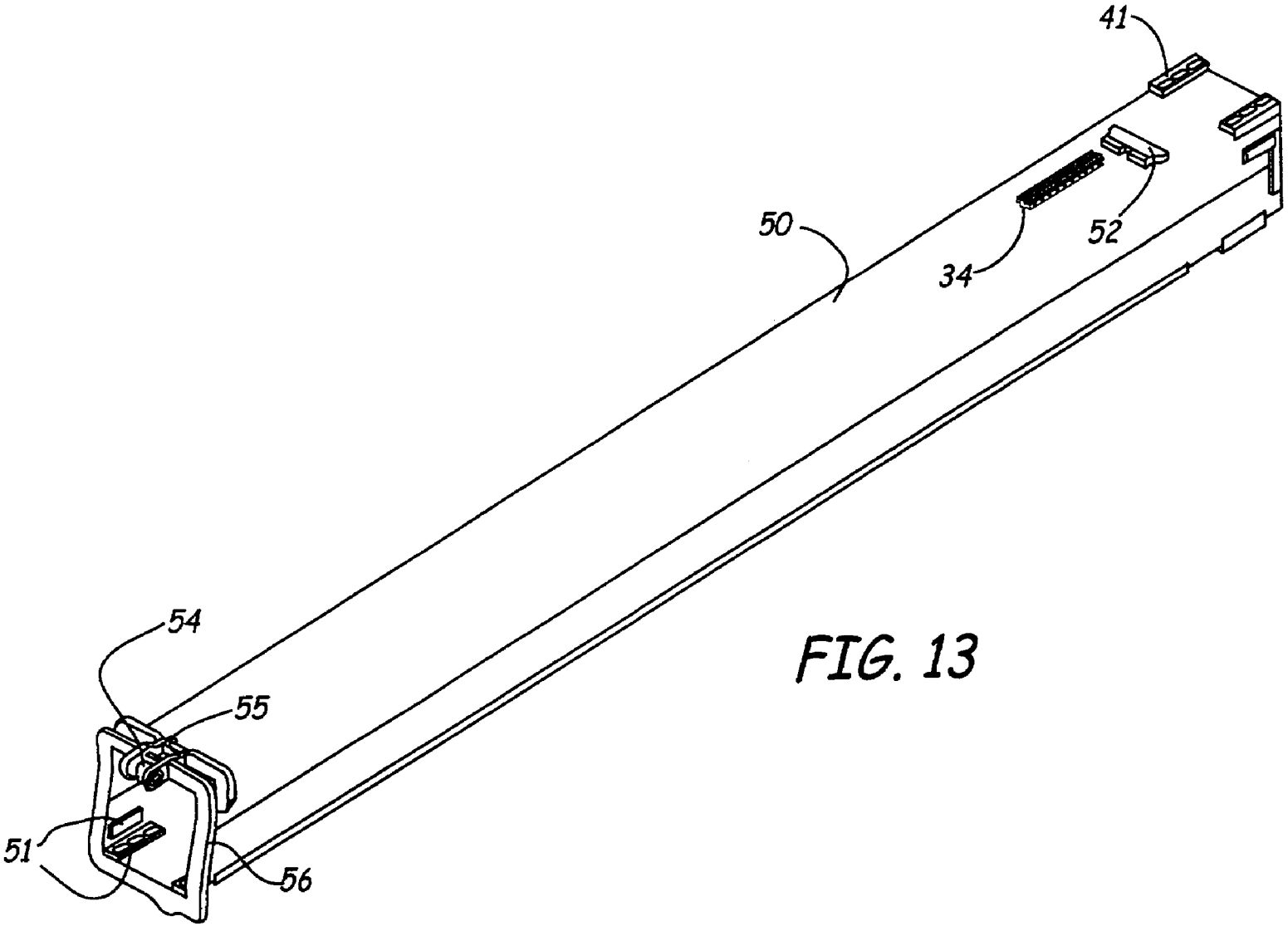
FIG. 13 is a perspective view of a third boom section, which telescopes into the interior of the second boom section shown in FIG. 10.
Figure 14:
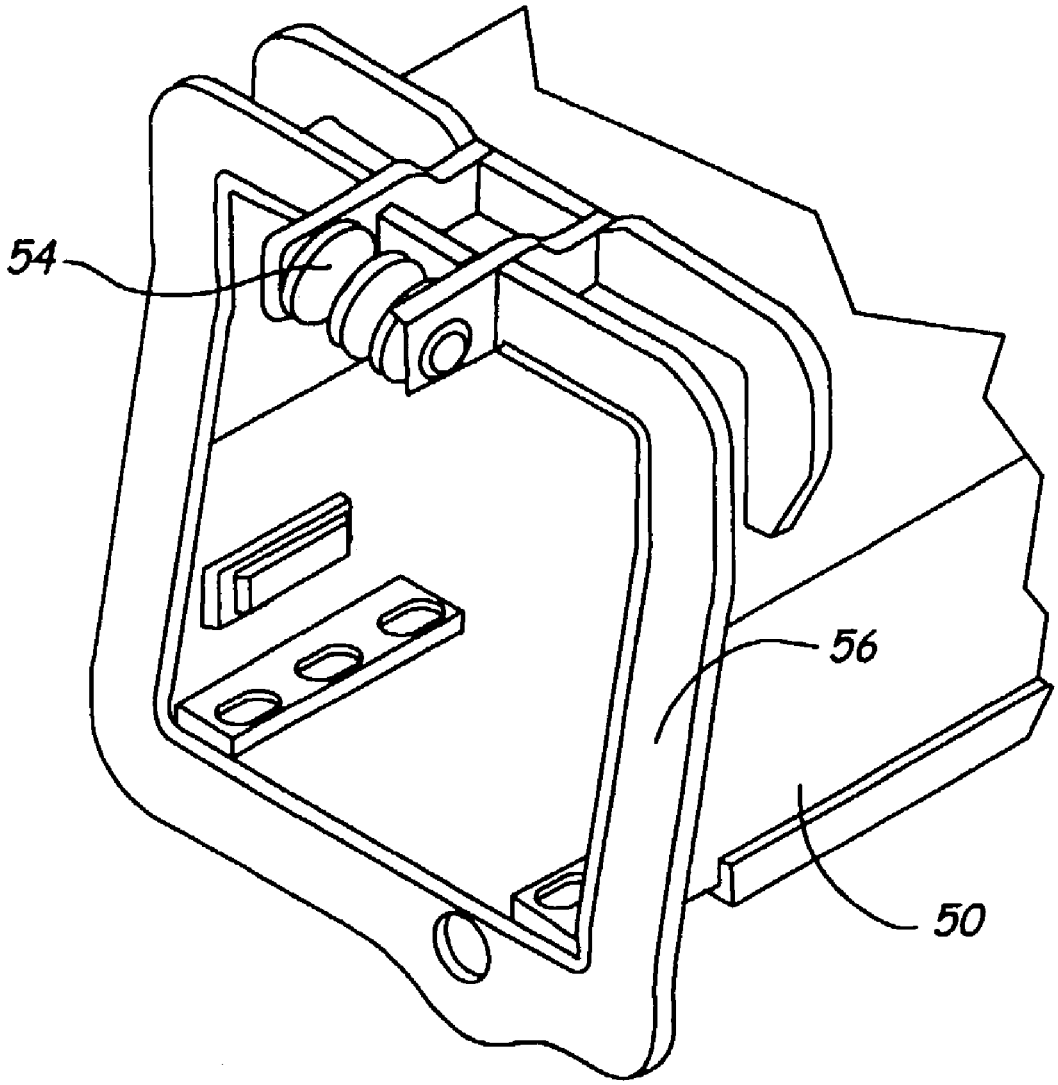
FIG. 14 is an enlarged perspective view of an outer end of the third boom section shown in FIG. 13.
Figure 15:
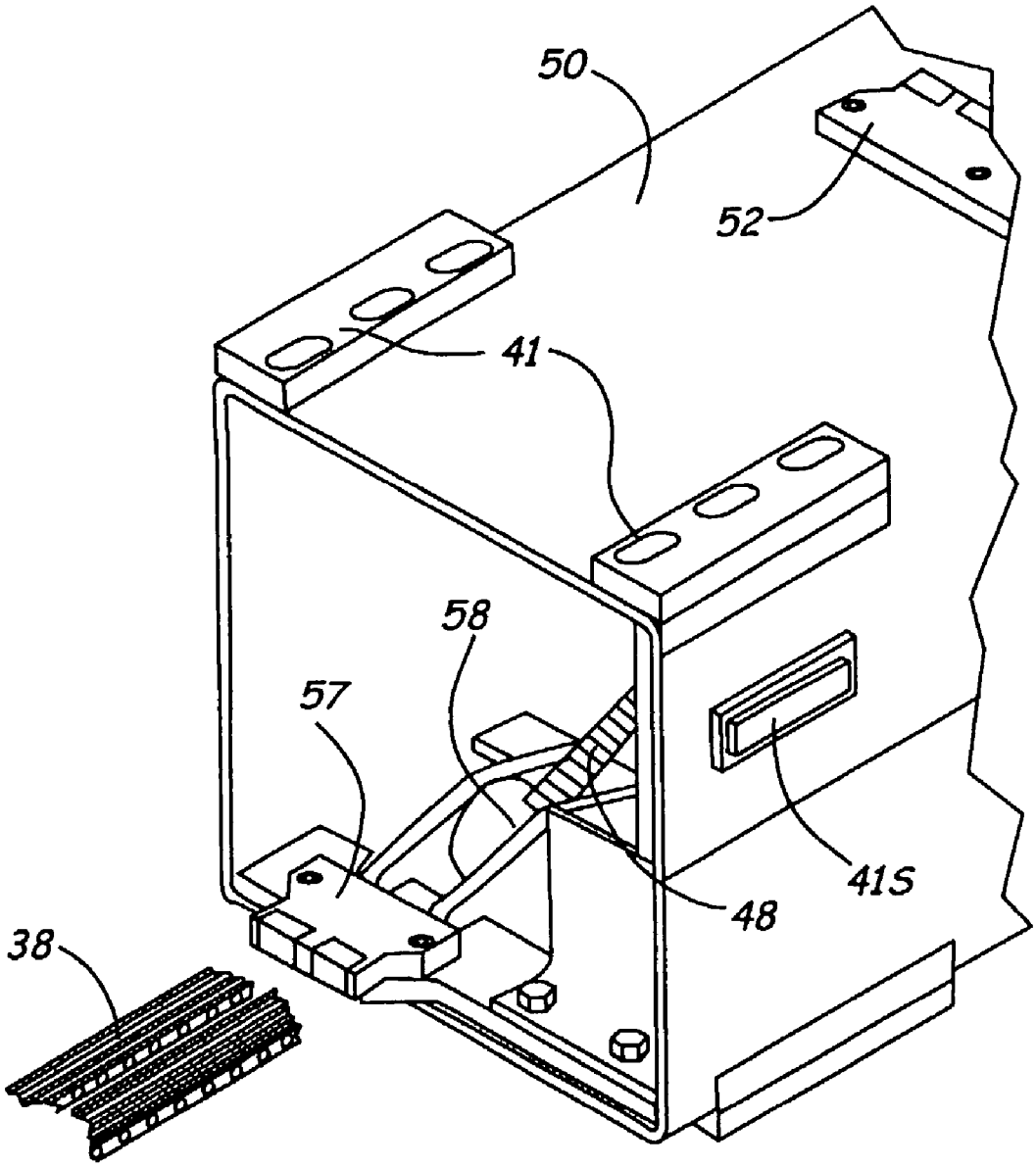
FIG. 15 is an enlarged perspective view of the base end of the boom shown in FIG. 13.

The third boom section 50 is illustrated in FIGS. 13, 14 and 15, and it can be seen there that the boom section 50 has the guides 41 at its base end, and 51 at its inner end. A number of guides can be used as desired, and side guide 41S are shown and used between all boom sections.

At the base end, the chain anchor 52 is illustrated, it is shown so that a plurality of four chain sections forming chain set 34 are provided. The chain sections are attached to the anchor 52 in a suitable manner. Additionally, the pulleys 54 for chains 44 are illustrated, and they are mounted onto a suitable bracket 55 that is fixed to the third boom section 50. A flange 56 is provided around the outside of the outer end of the boom section as shown. The chain sections 44 wraps around the pulleys 54 as shown in FIG. 2, and extend into the interior of the third boom section 50.

It should be noted that FIG. 15 is a view of the base or lower end of the boom section 50, and it in part illustrates the anchor 52 as well.

Figures 16, 17, 19:
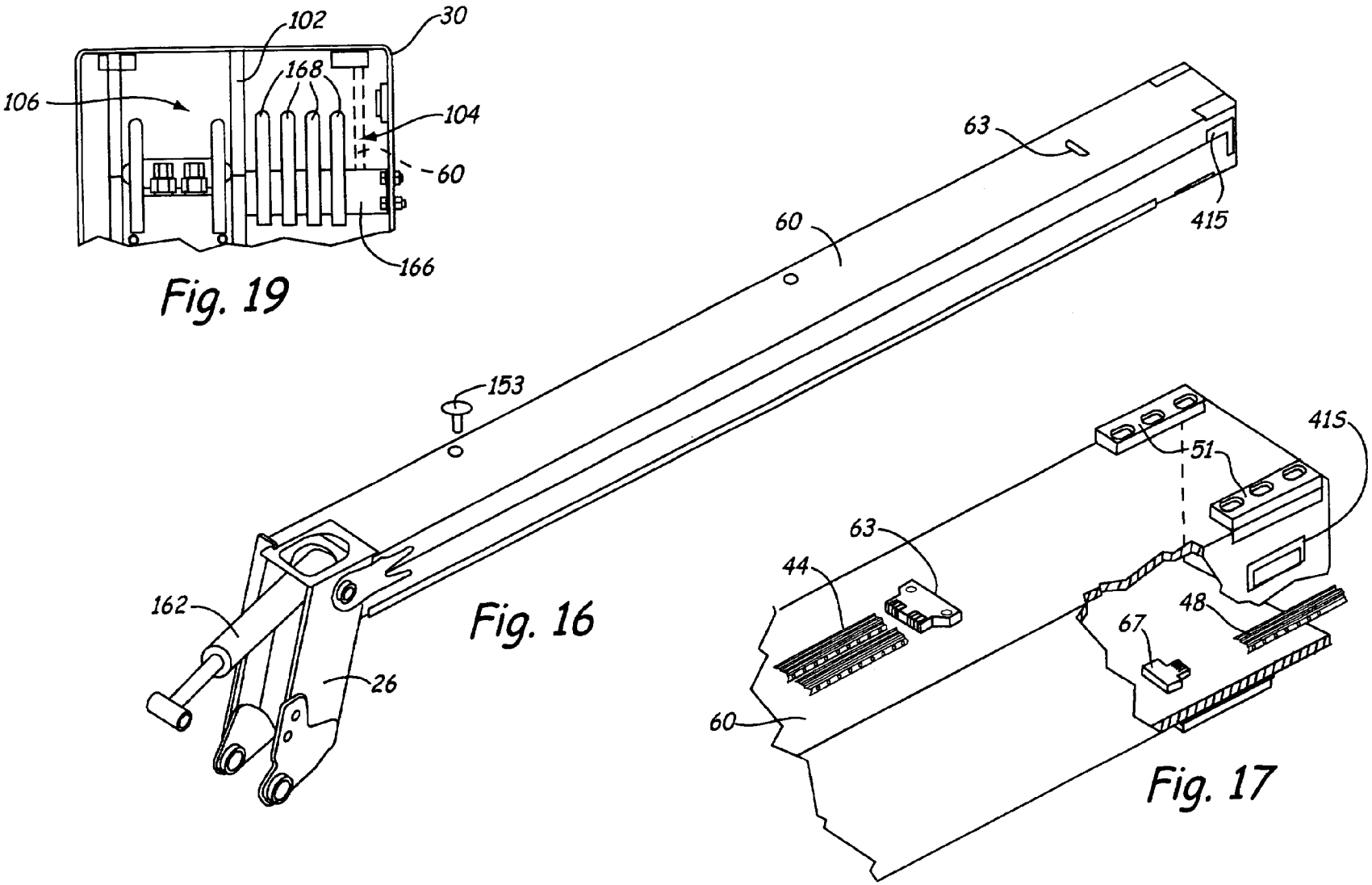
FIG. 16 is a perspective view of the fourth or outer end boom section which is used for carrying working implements at the outer boom section.
FIG. 17 is an enlarged exploded perspective view of the base end portion of the outer boom section shown in FIG. 16.
FIG. 19 is a fragmentary end view showing the connecting lines secured to the base boom section at the base end of the boom.

FIGS. 16 and 17 illustrate the fourth or outer boom section 60, and it should be noted that all of the boom sections are square tubes or rectangular tubes that slideably mount together. The wall thicknesses are selected for adequate strength. The fourth or outer boom end section 60, as shown, has an anchor 63 (see FIG. 2 also) for anchoring the chain set 44 at an inner or lower end of the boom section 60, and the linear bearings 51 are illustrated as well as side guides 41S. Additional linear bearings can be used for guiding the tubular boom sections as desired. The boom section 60 has an anchor 67 on the interior for chain 48, and has bracket 26 and a remote attachment cylinder 162 shown.

Thus, the connections of chains for the extension telescoping movement are shown. The hydraulic cylinder 70, moves section 30 and 40, directly, chain 34 acting over pulleys 42 on the second boom section 40 moves section 50 and chains 44 acting on pulleys 54 on the third boom section are anchored to and move boom section 60.

To cause the boom sections to properly nest together and contract, a second arrangement of pulleys are utilized on the lower side of the boom, also shown schematically in FIG. 2. The boom section 30 and 40 are again directly moved apart or together by cylinder assembly 70, since the rod 72 is attached to boom section 30 and the cylinder 76 is attached to boom section 40. The base boom section 30 has a chain anchor 39 that anchors a chain set 38, which is mounted over a pulley 47 on the base end of second boom section 40. Chain set 38 is anchored with an anchor 57 to the inner surface of the third boom section 50.

A chain anchor 49 at the outer end of boom section 40 is used for anchoring a chain set 48 that mounts over a pulley 58 at the inner or lower end of the third boom section 50. The chain set 48 passes through the interior of the third boom section 50 and is anchored with an anchor 67 at the inner or lower end of the fourth or outer boom section 60.

In FIG. 9, the chain anchor 39 is illustrated on the upper or outer end of the first boom section 30. The chain set 38 used is similar to those such as chain 34. In FIG. 12, the lower end of the boom section 40 is illustrated, and the pulleys 47 are shown supported on the cylinder attachment bracket 78. The chain set 38 passes over the pulleys 47 and into the interior of the second boom section 40, as shown in FIG. 2.

FIG. 15 shows the chain set sections 38 and the attachment bracket 57 at the inner or lower end of the boom section 50. Additionally, in FIG. 15, the pulley 58 is illustrated, and it can be seen that clearance is provided for the chain that would pass over pulley 58 and carry the chain set 48 shown in FIG. 2. The chain set 48 is represented schematically in FIG. 15, and comes from the interior of the boom section 50.

The illustration of the outer boom section 60 shows the anchor 67 in the section broken away in FIG. 17, and the chain set 48 that attaches to the anchor. Additionally, the anchor 63 is illustrated, in FIG. 16 which holds the chain set 44 in position.

The boom control cylinder assembly 70 is retracted for retracting the boom sections so that the rod 72 moves inside of the cylinder 76. The boom section 40 is directly moved into the first boom section 30 by the cylinder movement, and the chain set 38, which is anchored at bracket 39, will pull on the third boom section 50 and retract it relative to the second boom section 40. The chain set 48, which is anchored on the second boom section 40 will cause retracting a load to be put onto the bracket 67 on the fourth or outer end boom section 60 to cause section 60 to telescope as well, and all of the telescoping boom sections will nest together in a retracted position. It should be noted that all of the control chains for controlling the retraction telescoping action of the boom tubes, namely chains 38 and 48, and the pulleys and anchors are all to one lateral side of the boom assembly 20. The various pulleys and other brackets are made so that the tubes that telescope inside the outer tubes either terminate before they get to the brackets or clearance for the pulleys and brackets is provided. A divider 102 (FIGS. 12 and 19) can be used.

Figure 4:
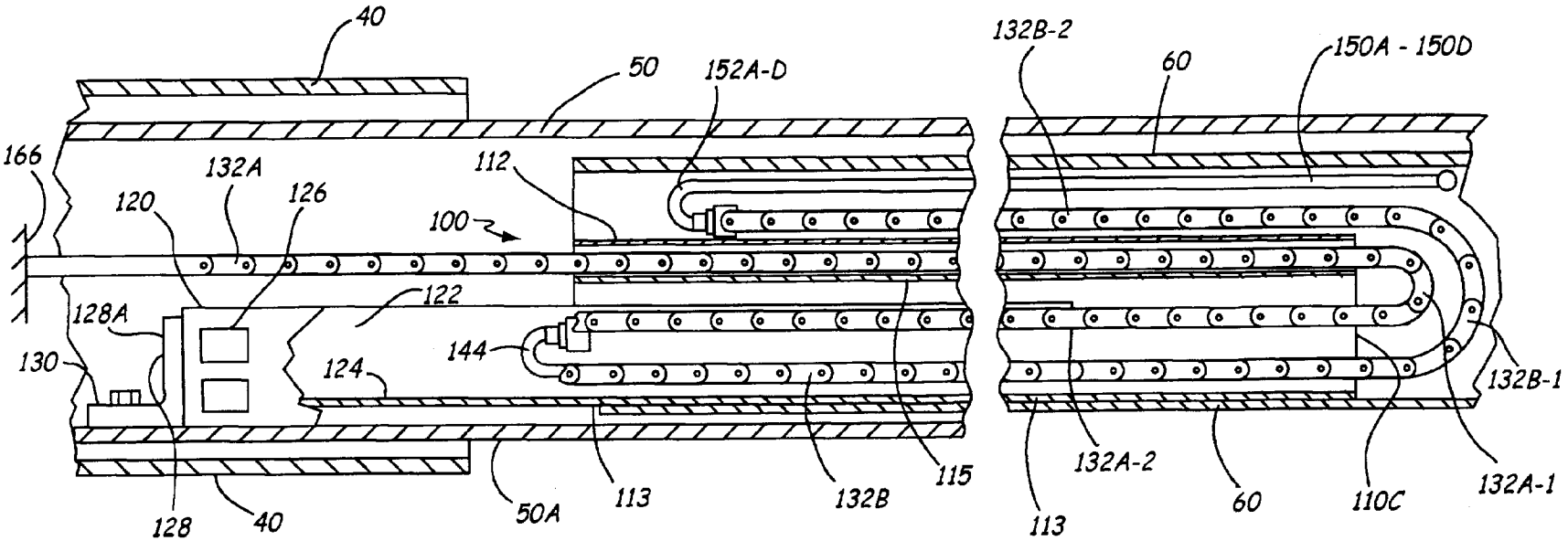
FIG. 4 is a fragmentary schematic sectional view of the hydraulic hose carrier on cartridge housing shown installed in two of the boom sections, and schematically illustrating the folding hose support chain.
Figure 5:
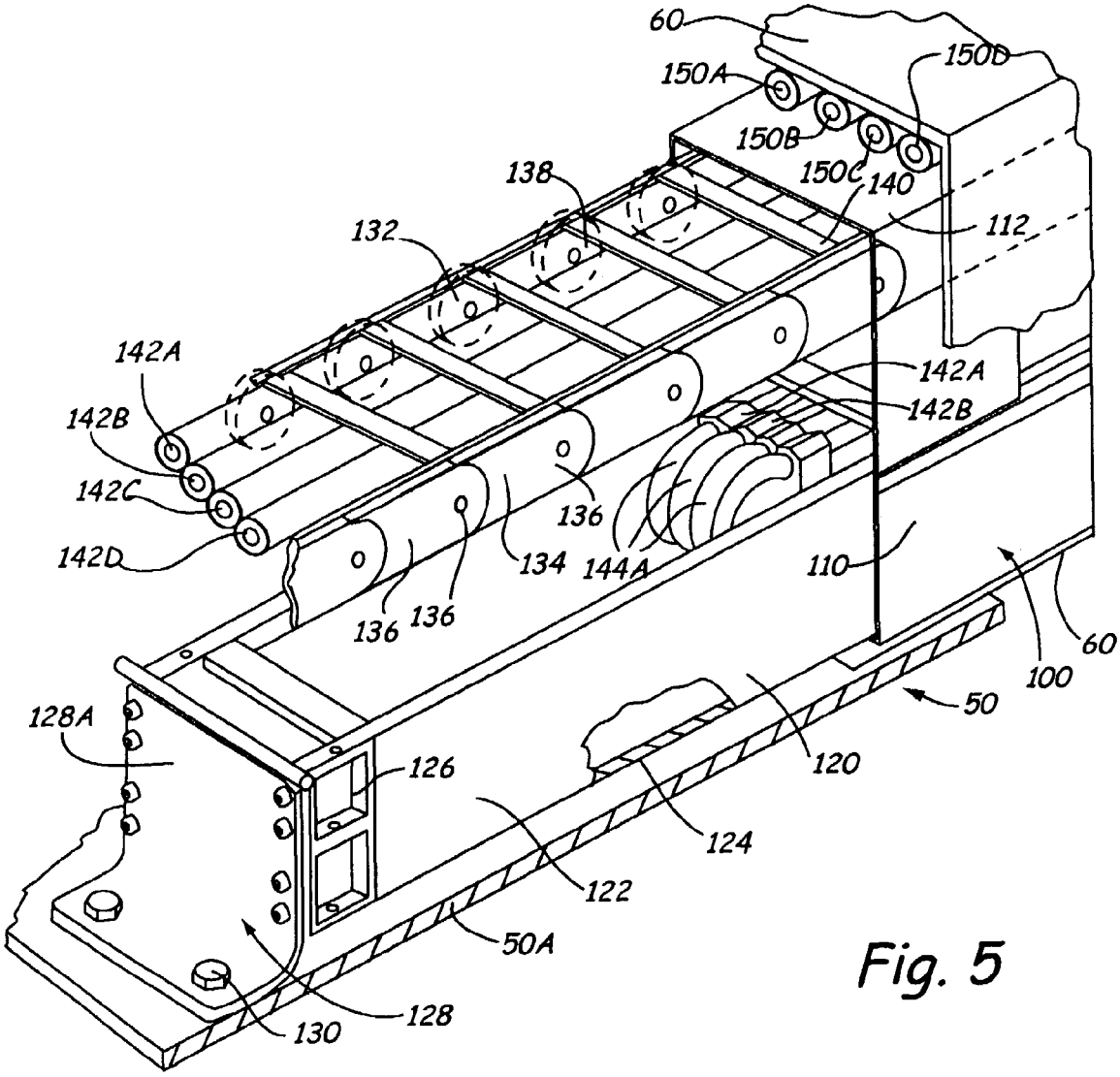
FIG. 5 is an enlarged fragmentary perspective view of the hose carrier housing and interior slide in position partially in an outer boom or section with hydraulic hoses partially unfolded.
Figure 7:
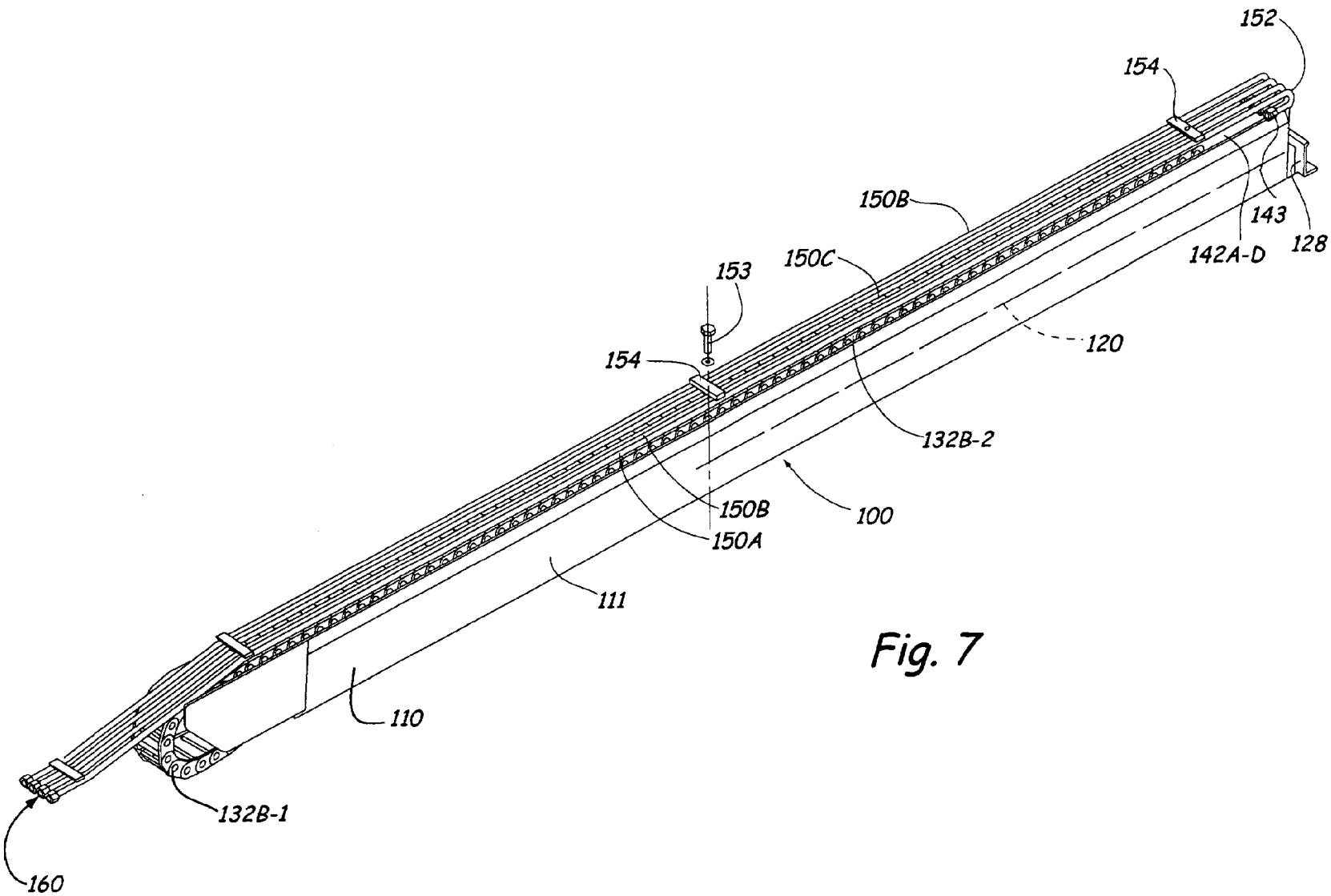
FIG. 7 is a perspective view of the hose carrier made according to the present invention with parts exploded for illustrative purposes.
Figure 8:
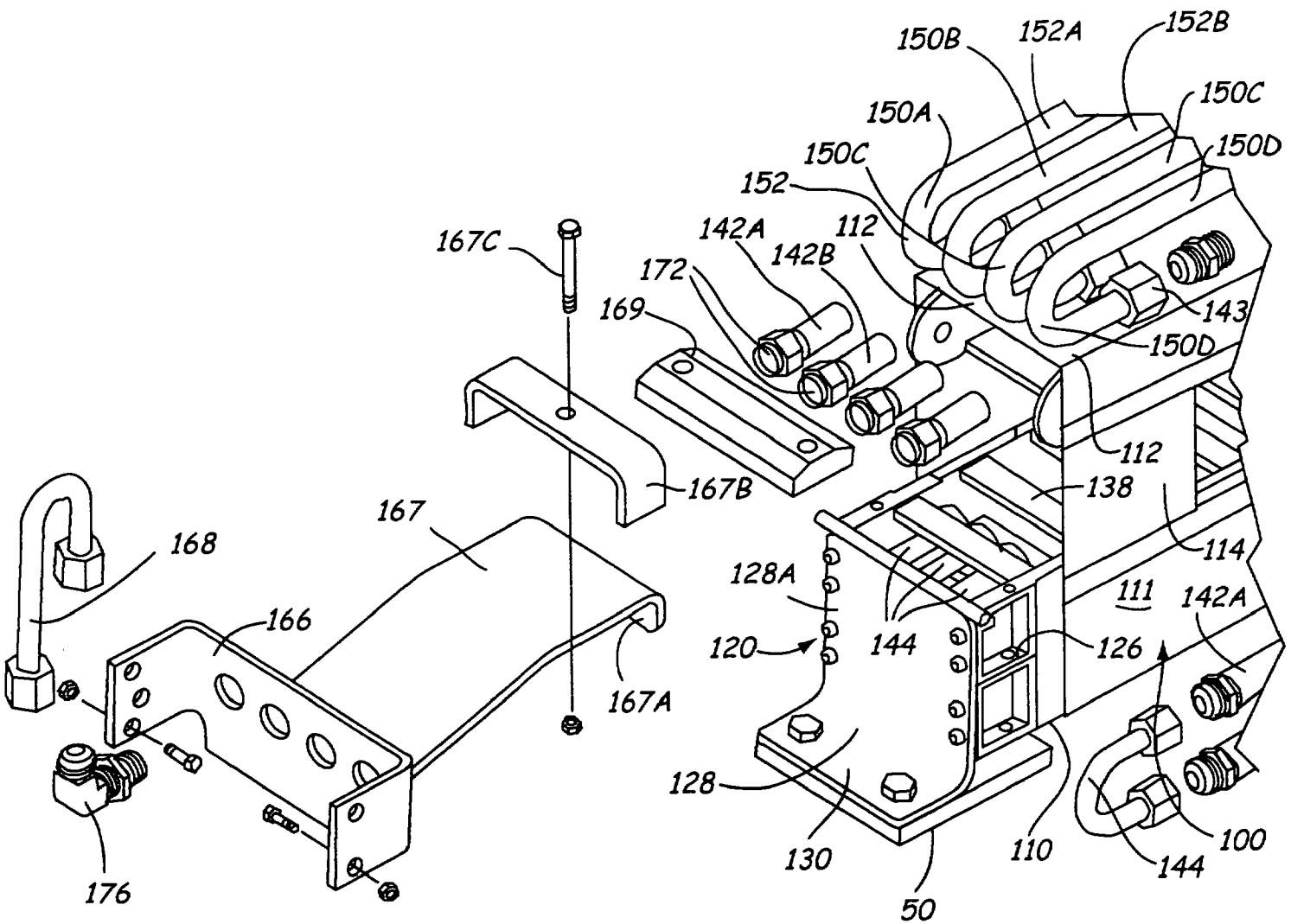
FIG. 8 is an enlarged perspective schematic view of an inner end of the hose carrier housing and an interior slide showing the attachment to the interior slide to an intermediate boom section.

The other lateral side of the boom assembly is used for mounting a hydraulic line and hose carrier or subassembly and is illustrated generally at 100 in FIGS. 5, 7, and 8 are shown installed in the third and fourth boom sections 50 and 60 in FIG. 4. A detail of the hose support chain is shown in FIG. 5 as well as in other figures.

The hydraulic line or hydraulic fluid content carrier subassembly 100, which will be called a hose carrier or cartridge, is made to be installed into and removed from the boom as a subassembly cartridge, and will mount so that it slides into the interior of the smallest size boom section, which is outer end boom 60. The hydraulic fluid conduits include flexible hose sections and metal tube sections, as will be shown. The fluid conduits have inlet ends at the base of the boom and outlet ends at the outer end of the boom. FIG. 19 illustrates the base boom section 30, with a dividing wall 102 that provides a side channel 104 in which the hose carrier subassembly 100 will fit on the smaller size telescoping tube section 60. The wall of the boom section or tube 60 is shown in dotted lines in FIG. 19 for illustrative purposes. The chamber 106 is at the lateral side where the hydraulic actuator 70 mounts.

Figure 18:
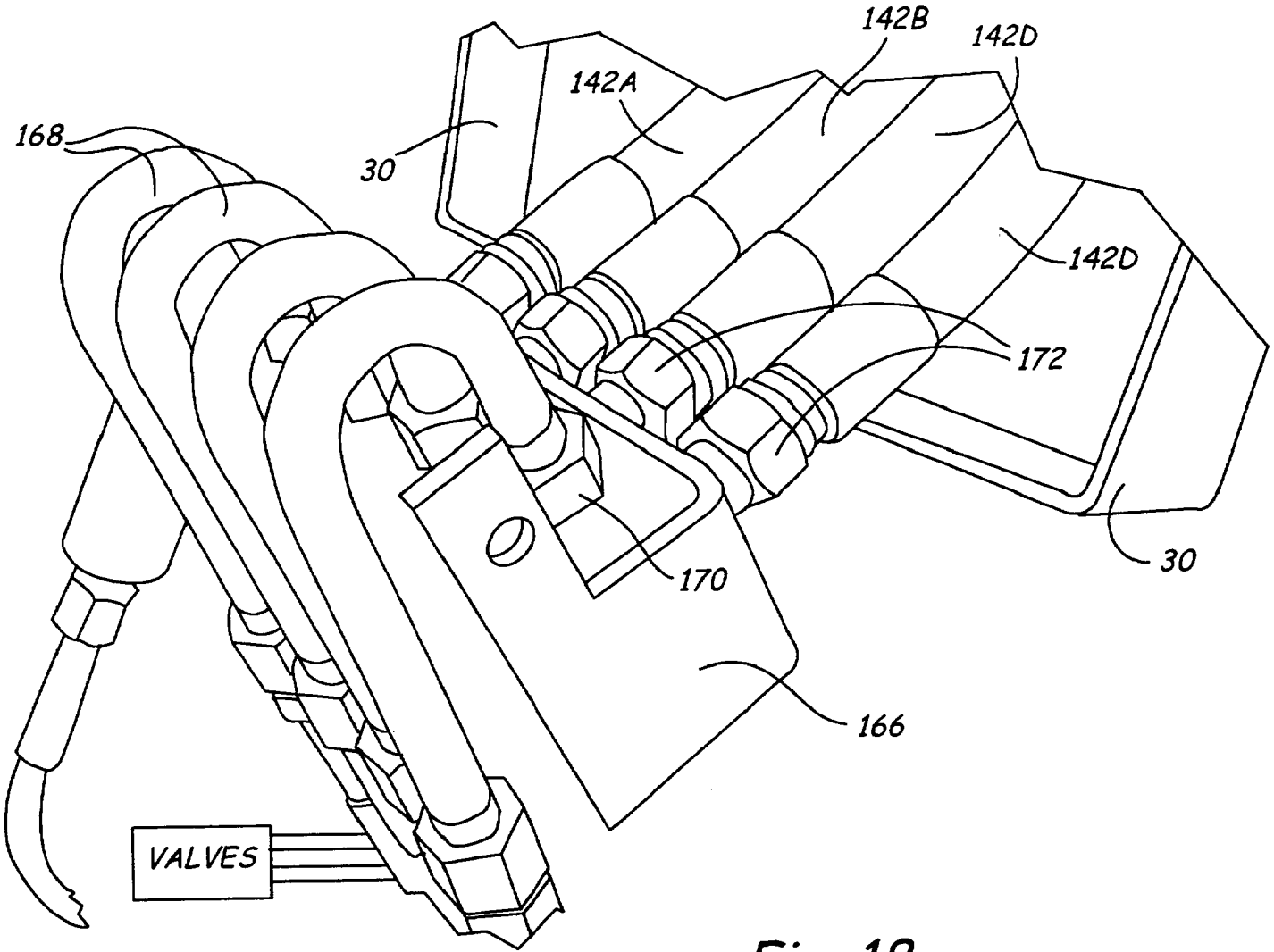
FIG. 18 is a perspective view of the base end of the hydraulic hoses carried in the base boom section disconnected from the base boom section for illustrative purposes.

FIGS. 7 and 8 will be referred to initially. The hydraulic hose carrier or cartridge 100 has an outer metal housing 110, that is also shown in FIGS. 5 and 8, and has side walls 111, a metal base wall 113 (FIG. 4), and a top wall 112 that is parallel to the base wall. Each of the side walls 111 can be a continuous side wall but as shown in FIG. 8, the side wall 111 can be made into top and bottom sections wherein the top wall 112 is channel shaped and has a bent down side section, and the lower wall 113 has an upright bent section and they are joined together with suitable vertical members such as that shown at 114 to form the side walls. In any event, the outer housing 110 forms a rectangular shaped housing in which folding hose carriers can slide. Also, an intermediate support wall 115 can be provided for supporting a length of the hose. The hose level on wall 15 in FIG. 7 is attached and supported at the base end of the boom, as shown in FIG. 18.

Reference is made to FIGS. 4 and 5. The hose carrier housing 110 is made of size to fit into the fourth boom section 60, and slides into the side channel 104, shown in FIG. 19 in boom section 60. The hose carrier includes a inner hose support slide 120, that can be seen in FIG. 5, as well as in FIG. 8. This hose support slide 120 is like a drawer that essentially slides in and out of housing 110, and has side walls 122, as well as a bottom wall 124. The end of the slide 120 has a pull bracket 126 attached thereto, and bracket 126 is made so that it will pull on the entire slide or drawer 120, and when the bracket 126 is pulled, the slide or drawer 120 will be pulled or pushed into the hose carrier housing 110.

The bracket 126 is attached to a mounting bracket 128 that has an upright wall 128A fixed to the end of bracket 126 and a flange 130 that extends down below the lower wall 124 of the slide as well as the lower wall of the hose carrier housing 110, and also extends farther down, or lower than, the bottom wall of the fourth boom section 60. The flange 130 rests against the inner surface of the bottom wall 50A of the intermediate boom section 50, and is releasably fixed thereto with suitable cap screws, as shown, when the hose carrier 100 is in position. This bracket is accessible at the base end of the retracted boom.

The hydraulic hoses are flexible, and are mounted into a known flexible, chain like, hose guide and support 132. As shown in FIG. 5, the flexible hose guide, which is commercially available, is like a plastic chain in that it is made up of a number of individual links 134 that have ends overlapped, and pivoted together with pivot pins 136.

Figure 6:
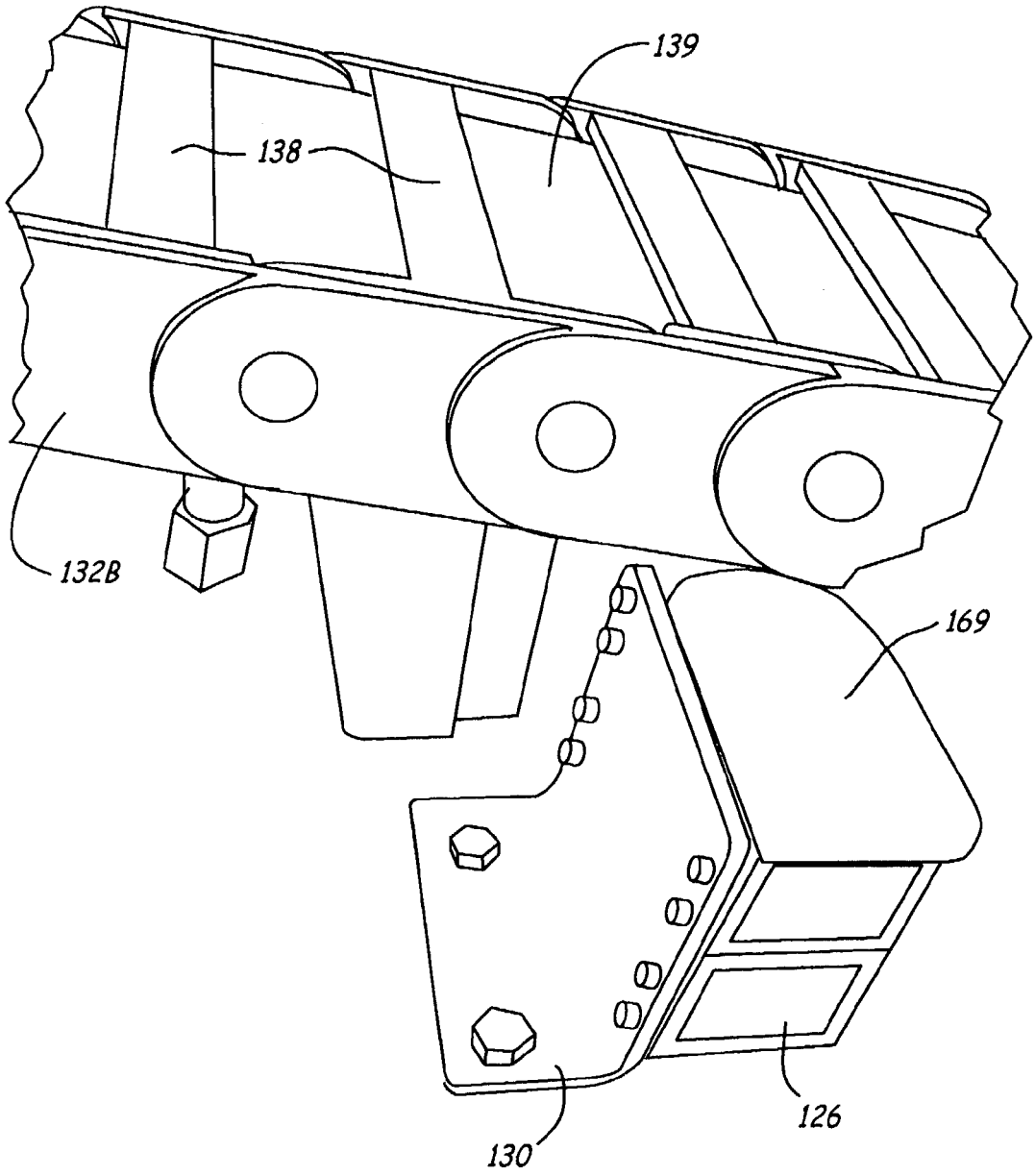
FIG. 6 is a fragmentary perspective view of base end of the hose carrier removed from the telescoping boom assembly with a portion of the house carrier shown.

The individual links 134 of the chain link hose guide have cross bars 138 along one edge thereof, as shown, the top edge, and cross bars 140 on the lower edge thereof (FIG. 20) so that the cross bars span the space between side members of the links 134 to form a chamber or slot that will receive a number of flexible hydraulic hoses shown at 142A–142D in FIG. 5. The hoses fit in the slot or chamber between the bars 140 and 138 of each link 134 and extends longitudinally along the hose guide or support chain. Since the hoses themselves are flexible, the bending of the hose guide or support chain link about the pivot pins 136 between each of the links is accommodated without overstressing the hoses. A protective layer of plastic 139 can be placed over the hoses as shown in FIG. 6.

Chain like hose guides are provided in the present device in two separate length or sections. Reference is now made to FIG. 4 as well as FIGS. 5, 7, 8 and 20. In FIG. 4, the two sections 50 and 60 of the boom are shown but portions are broken away. The fourth or outer boom section 60 is illustrated telescoped into the third boom section 50, which also is partially telescoped into the second boom section 40 in FIG. 4. The boom sections are partially extended (not fully retracted) in these illustrations of the invention. The chain type hose guides or supports include a base hose guide section 132A that, as will be explained, has the inlet ends of the hoses 142A–142B secured to the base end of the first or base boom section 30. The hose guide section 132A is inside the housing 110 of the hose carrier or cartridge 100, and is positioned above the hose drawer like slide 120.

As can be seen in FIG. 4, the section 132A extends out beyond the base end of the hose carrier housing 110. The carrier housing 110 is on the interior of the outer boom section 60. A bend to double back hose guide or support section 132A and the hoses on themselves is shown at 132A-1 in FIG. 4. The hose guide section 132A and the hoses double back (without any separate connectors), to include a section 132A-2 which is inside slide 120. This hose guide section 132A-2 carries the hoses toward the base end of the boom, and as shown in FIGS. 5 and 8, to formed connecting metal connector tubes 144, one for each of the hoses 142A–142D. The connecting tubes 144 makes a sharp formed bend for changing direction of the hydraulic line and doubling back of the hoses in the hose slide and also to permit keeping the hose lengths reasonable and not excessively long.

Figure 20:
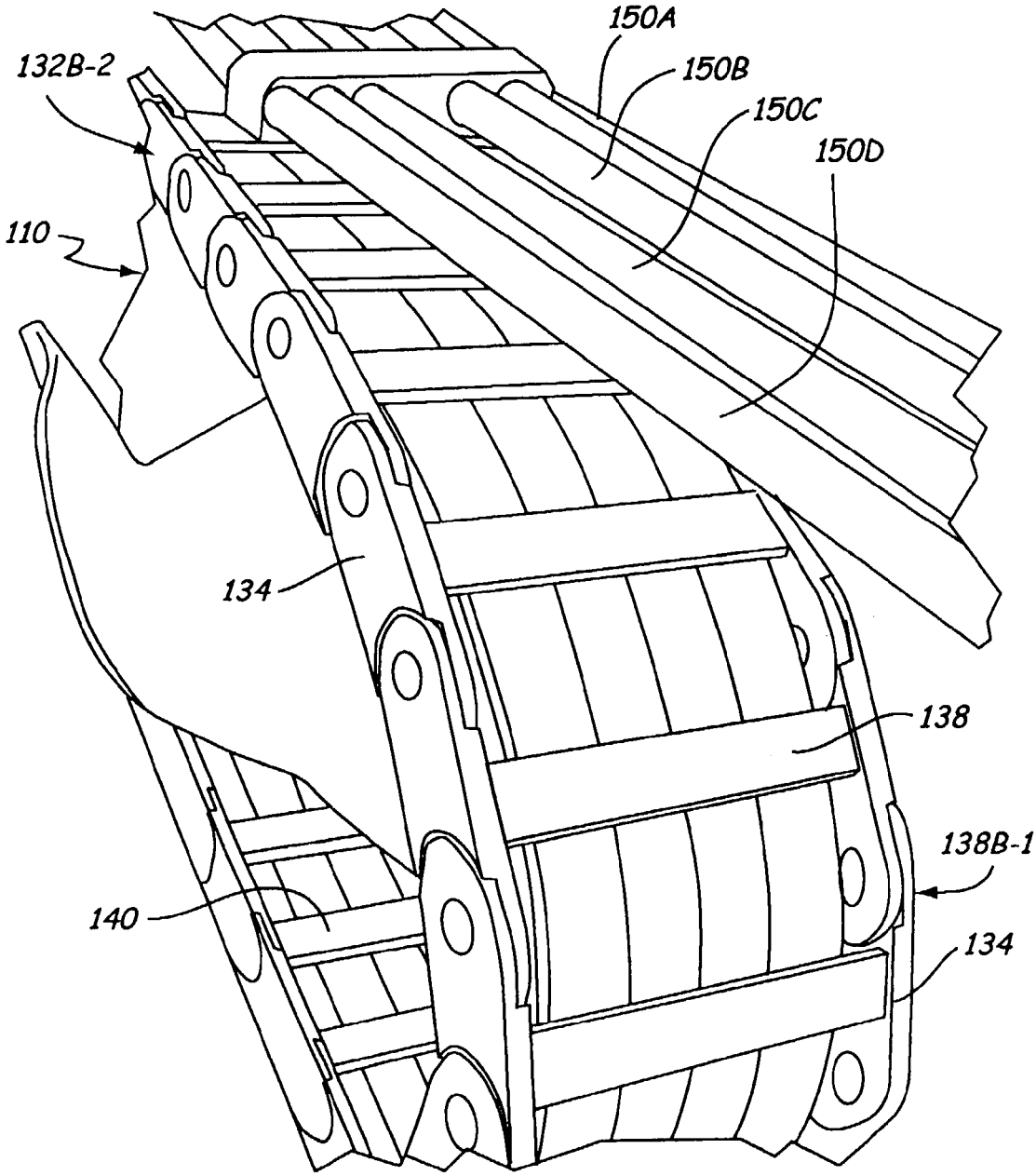
FIG. 20 is a fragmentary enlarged perspective view of the outer end of the hose carrier housing.

The connecting bent tubes 144 join flexible hoses (shown exploded from the hose carrier in FIG. 8) in a second chain hose guide or support section 132B (FIG. 4) made up of the pivoting links 134, and extending back inside the hose slide 120 to a outer end bend 132B-1. The hose guide 132B extends out of the hose carrier housing 110 and bends back upon itself at 132B-1 and a section 132B-2 rests on the top wall 112 of the hose carrier housing 110. FIGS. 7 and 20 illustrate this section 132B-2 of the hose guide or support, and also the bend portion 132B-1. The connection fitting for bent tubes 144 are accessible from the open base of the boom when the boom is retracted, and not up inside the tubes.

To complete the hydraulic line hookup, a plurality of metal tubes, not hoses, indicated at 150A, 150B, 150C and 150D are positioned above the hose guide section 132B-2 and ends are connected to hoses carried by the hose guide 132B-2. These lines 150A–D have formed bend portions 152A–D at the base end of the hose carrier housing 100, to make the tight turn or bend to reverse direction and join the hoses in hose guide section 132B-2 and still take up a minimum amount of space so that the entire hose assembly and housing can slide inside the inner boom section 60 as shown in FIG. 4. The connectors 143 from tubes 150A–D to hoses 142A–D (FIG. 8) are also accessible at the open base end of the boom when the boom sections are retracted.

The tubes 150A–150D are secured to the upper wall with cap screws 153 that pass through openings in the upper wall of boom section 60 and thread into openings in plates 154 that are welded to the lines 150A–150D in two locations, near the outer end of the boom section 60. These cap screws 153 are accessible when the boom section 60 is one partially extended from its retracted position. These cap screws are the only connection to the boom section 60, and can be removed when the boom is only partially extended, so the removal is easy.

The outer ends of the lines 150A–150D have fittings, as shown generally at 160 in FIG. 7 that attach to hoses leading to the remote implements, as well as the auxiliary actuator that is shown in FIG. 16 at 162. These fittings are also accessible when the boom is retracted, or partially extended. The hose carrier also can support electrical control lines.

Thus, the hose carrier assembly or cartridge 100 is slid into the boom section 60, but the carrier is not secured to this boom section. The connection of the fluid conduits to boom section 60 is through the cross plates 154 welded to tubes or lines 150A–150D. The slide 120 is releasably secured to the boom section 50 with brackets 126 and 128. The inlet ends of hoses 140A–140D are held on the base boom section 30 with a suitable bracket 66 shown in FIG. 8 in exploded view, and also in FIG. 19. The bracket 166 bolts to the side walls of the base or first boom section 30. The bracket 166 has a tongue 167 that hays a flange 167A that hooks onto the hose guide 132 at the end and a clamp 167B and bolt 167C are used to hold the end of the hoses and hose guide relative to the base of boom section 30.

Connecting U-shaped metal tubes illustrated at 168 in FIGS. 18 and 19 are used for connecting to fittings 170 that attach to the end fitting 172 of hoses 142A–142D. The opposite ends of connection tubes 168 attach to valves for hydraulic control. These connections are also accessible at the open base end of the boom.

One or more blocks 169 (shown in exploded view in FIG. 8) can be secured to the slide 120 to support the hose guide section 132B as the hose guide slides past the slide 126. To understand how the hydraulic hoses and the chain type hose guides are payed out as the boom section extend, FIG. 4 illustrates that with the hose guide section 132A secured with the bracket represented schematically at 166 in FIG. 4 and with the hose bend portion 132A-1 free to move, the inlet ends of hoses 140A–140D will remain at a fixed location relative to the base boom section 30 when the other boom sections extend. This will cause the hose bend 132A-1 to essentially roll or travel and pull on the hose guide section 132A-2. The connecting tubes 144 will move away from the mounting bracket 126 of the slide 120. The slide 120 will remain with the boom section 50, as shown in FIG. 4. The boom section 60 will be moved out, and this will cause the bend portions 152 of the metal lines 150 of the base carrier to move, the flexible hose bend portion 132B-1 to unroll, as well, and this combined movement will cause the flexible hose guides to tend to straighten, and accommodate the necessary change in length of the boom assembly without binding or bending or damaging the hoses in any manner. The folds or bend ends 132B-1 are continuous hoses with no filling at the end of the housing inside the boom sections.

The hose carrier housing 110 will remain in the boom section 60 even though it is not directly attached. The lines 150A–150D will remain secured to the upper side of boom section 60 in their fixed position so that the ends connected to remote hydraulic implements at bracket 26 will not change in length and the slide is held on tube section 50, and the inlet end of the hoses are held on base boom section 30, so the hoses straighten and re-fold under control.

When the boom sections are retracted, the opposite action occurs, and as the boom section 50 slides back into boom section 40 and thus back into boom section 30, the hose guides will again retract with an opposite movement at the bend portions 132A-1 and 132B-1, and the connecting tubes 144 and the tube slide will move back to the position shown in FIG. 8.

FIG. 5 shows a partially extended position of the boom slide as well, and shows the connector tubes 144 for joining the hose guide 132A and 132B together on the slide 120. The fitting or connector tube 144 moves to the base end as the boom retracts fully.

The entire hose or fluid conduit assembly, including the hose guides, the connector tubes 144, and the hydraulic tubes 150A–150D can all be preassembled as a unit, as shown in FIG. 7, and then slid into the boom section 60. The boom section 60 is partially extended to permit fastening the plates 154 with the cap screws 153 through the top wall of the boom section 60. Also the bracket 128 and flange 130 can be secured to the tube slide and the inner surface of boom section 50. When, and if, service is required, the two cap screws 153 that hold the brackets 154 are removed. When the boom sections are retracted, the bracket 166 can be released (see FIG. 6) and the cap screws in flange 130 are right at the base end of the boom and can be removed. Then, the cap screws that retain the flange 130 on boom section 50 is all that is necessary to complete removal the hose carrier subassembly or cartridge 100. The entire hose cartridge 100, including the fluid conduits and slide 120, can be slid out of the boom for service.

All of the hydraulic connections or filters, as can be seen in FIGS. 7, 8, 18 and others are on the exterior (at the outer end of end boom section) or at the open ends of the boom sections, so there are no fittings that are positioned half way into the boom tubes. The bend tube sections 144 are accessible at the base end of the boom, because they retract back to the bracket 126. The connections at the outer ends of the lines 150 connected to remote attachments with connectors 160 also are accessible from the exterior. The connections 143 between the bend portions 152A-D and the hoses in the hose guide section are also accessible.

The subassembly 100 is easily put together, separate from the boom, and is readily inserted for use and then removed as a unit for service.

Although the present invention has been described with reference to preferred embodiments, workers skilled in the art will recognize that changes may be made in form and detail without departing from the spirit and scope of the invention.

What is claimed is:

1. A removable and replaceable subassembly hose carrier for a hydraulic fluid conduit having an inlet end and an outlet end and mountable in an extendable boom having at least two tubular boom sections that longitudinally extend and retract relative to each other, with an inner boom section and an outer boom section, the hose carrier comprising a housing, a flexible hose guide that folds to double back upon itself in the housing and which unfolds so a length of the hose guide increases as the hose guide unfolds, at least one hose forming a part of the fluid conduit carried by the hose guide, the at least one hose comprising an inlet end of the fluid conduit, and the at least one hose joining another portion of the fluid conduit, the other portion extending to an outlet end of the fluid conduit, the at least one hose and the hose guide being adapted to extend in length when the outer end is moved in a direction away from the inlet end, the housing being of size to fit entirely within an inner boom section of an extendable boom in which the housing is placed, the inlet end of the fluid conduit having a first bracket releasably securable to a base end of an outer boom section of an extendable boom in which the housing is placed, and the outlet end of the fluid conduit having a second bracket releasably securable to an outer end of an inner boom section of an extendable boom in which the housing is placed, the housing and the fluid conduit being slidable into and out of an extended boom when the first and second brackets are released from respective boom sections.

2. A removable and replaceable subassembly hose carrier for a hydraulic fluid conduit having an inlet end and an outlet end and mountable in an extendable boom having at least two tubular boom sections that longitudinally extend and retract relative to each other, with an inner boom section and an outer boom section, the hose carrier comprising a housing, a flexible hose guide that folds to double back upon itself in the housing and which unfolds so a length of the hose guide increases as the hose guide unfolds, at least one hose forming a part of the fluid conduit carried by the hose guide, the at least one hose comprising an inlet end of the fluid conduit, and the at least one hose joining another portion of the fluid conduit, the other portion extending to an outlet end of the fluid conduit, the at least one hose and the hose guide being adapted to extend in length when the outer end is moved in a direction away from the inlet end, the housing being of size to fit entirely within an inner boom section of an extendable boom in which the housing is placed, the inlet end of the fluid conduit having a first bracket releasably securable to a base end of an outer boom section of an extendable boom in which the housing is placed, and the outlet end of the fluid conduit having a second bracket releasably securable to an outer end of an inner boom section of an extendable boom in which the housing is placed and further including a slide slidable into and out of the housing having a base end adapted to be attached to a boom section of an extendable boom in which the housing is placed, the hose guide and the at least one hose being foldable inside the slide, the slide being slidably movable out of the housing whereby the hose guide and the at least one hose in the slide unfold.

3. A hose carrier for carrying a plurality of hydraulic fluid conduits between a base end of a multiple boom section telescoping boom, and an outer end thereof, and providing movement of the fluid conduits during telescoping movement of such boom sections, comprising a housing, such housing having a top wall and being of size to be placeable in an inner boom section of a selected telescoping boom, the fluid conduits being positioned side by side in the housing and each fluid conduit comprising in part flexible hose sections to fold into positions overlying other hose sections of the same fluid conduit when in a first position, the hose sections being unfolded when in a second position, the at least one fluid conduit having an outer end adapted for attaching to an outer end of an inner boom section of a telescoping boom in which the housing is installed, and the fluid conduits each having an inlet end adapted for attaching to a base section of a telescoping boom when the housing is installed in such telescoping boom, the housing being removable from and replaceable into an inner boom section in which it is installed when the fluid conduits are unattached from such boom, said housing having a sliding drawer member moveable relative to the housing, said sliding drawer member being attachable to a base end of an intermediate section of a multiple section boom which is between an outer boom section and an inner boom section of a boom in which the housing is installed, the fluid conduits each including an outlet metal tube forming an outlet end portion thereof, and a bracket on the outlet metal tubes for attaching the outlet metal tube to an end of an inner boom section of a boom in which the housing is installed at a location adjacent an outer end of such inner boom section, a section of each fluid conduit comprising metal junction tube extending between flexible foldable hose sections of the respective fluid conduit positioned in the sliding drawer member adjacent a base end of the sliding drawer member, the metal junction tubes having connections accessible from an end of the housing, a flexible hose guide carrier carrying at least part of the flexible hose sections, and the flexible hose guide having a section on an interior of the housing, the hose guide forming a loop around an outer end of the top wall of the housing and extending back toward a base end of the housing, the flexible hose sections and the hose guide being supportable on an upper outer surface of the top wall of the housing, and ends of the flexible hose sections on the upper outer surface of the top wall being joined to a respective outlet metal tube, the outlet metal tubes extending toward an outer end of the housing.

4. The hose carrier of claim 3, wherein the flexible hose sections are carried in a flexible hose support.

5. The hose carrier of claim 3, wherein the fluid conduits comprise first hose sections that have first ends that are secured to and extend from a base end of a boom section in which the housing is installed, and secured thereto, and which flexible hose sections are folded to provide four overlapping lengths with bend portions between the lengths in a retracted position, second ends of the overlapping lengths of hoses being attached only to a respective outlet metal tube.

6. In a multiple section telescoping boom that is extendable and retractable and having at least an outer boom section and an inner boom section telescoped into the outer boom section, the improvement comprising a carrier for fluid conduits carrying hydraulic fluid under pressure from a base end of the outer boom section of the telescoping boom to an outer end of the inner boom section of the telescoping boom, said carrier comprising a housing of size to slidably fit within the inner boom section, said housing having at least one fluid conduit supported therein including a bendable flexible hose section that is folded upon itself to form conduit portions that overlap each other, the at least one fluid conduit having an inlet end at one end of the housing adjacent the base end of the outer boom section, and having an outlet end extending outwardly from the housing, a first bracket releasably fixedly mounting the inlet end of the at least one fluid conduit to the base end of the outer boom section, the first bracket being accessible from an exterior of the carrier housing, a second bracket adjacent the outlet end of the at least one fluid conduit releasably attached to the outer end of the inner boom section in a position to be accessible from an exterior of the inner boom section when the inner boom section is partially extended relative to the outer boom section, the housing being removable from the inner boom section at a base end thereof when the first and second brackets are released from their connections to the respective boom sections.

7. The improvement of claim 6 wherein the telescoping boom has an intermediate boom section that is slidably mounted in the outer boom section, and wherein the inner boom section is slidably mounted in the intermediate boom section, a slide mounted on said housing, the slide being longitudinally slidable relative to the housing, the slide having a base end that is releasably fixed to the intermediate boom section at a position accessible from a base end of the intermediate boom section when the boom sections are in a retracted position, the bendable flexible hose sections including portions folded within the housing and supported on the slide, and other portions that are supported in the housing to an exterior of the slide, whereby as the telescoping boom is extended, the outer end of the at least one fluid conduit is pulled by the inner boom section to tend to unfold the flexible hose section, and the slide remains fixed relative to the intermediate boom section as the inner and intermediate boom sections are telescoped outwardly from the outer boom section.

8. The improvement of claim 7, wherein the conduit portions that overlap each other within the housing are joined at a base end of the conduit portions by a pre-bent metal tubing, said pre-bent metal tubing being accessible from the base end of the outer boom section of telescoping boom when the telescoping boom is retracted.

* * * * *

UNITED STATES PATENT AND TRADEMARK OFFICE

CERTIFICATE OF CORRECTION

PATENT NO. : 7,090,086 B2
APPLICATION NO. : 10/428472
DATED : August 15, 2006
INVENTOR(S) : Henri R. M. Depre et al.

It is certified that error appears in the above-identified patent and that said Letters Patent is hereby corrected as shown below:

On Title Page and Col. 1, Line 1
Title page, item 54, delete "EXTENDIBLE" and insert --EXTENDABLE--.

Signed and Sealed this

Twenty-fourth Day of April, 2007

JON W. DUDAS
*Director of the United States Patent and Trademark Office*